US006554531B2

(12) United States Patent
Bodish

(10) Patent No.: US 6,554,531 B2
(45) Date of Patent: Apr. 29, 2003

(54) APPARATUS FOR DRYING AND COMPACTING EARTHEN MATERIALS

(76) Inventor: Brian K. Bodish, 1703 Concordia St., Pittsburgh, PA (US) 15210

( * ) Notice: Subject to any disclaimer, the term of this patent is extended or adjusted under 35 U.S.C. 154(b) by 18 days.

(21) Appl. No.: 09/834,204

(22) Filed: Apr. 13, 2001

(65) Prior Publication Data

US 2002/0150425 A1 Oct. 17, 2002

(51) Int. Cl.[7] ..... E01C 23/14
(52) U.S. Cl. ..... 404/77; 404/79
(58) Field of Search ..... 404/77, 79, 95, 404/131

(56) References Cited

U.S. PATENT DOCUMENTS

| | | | | | |
|---|---|---|---|---|---|
| 3,080,800 | A | * | 3/1963 | Malzahn | 126/271.2 R |
| 3,105,133 | A | * | 9/1963 | Norton | 126/400 |
| 3,331,297 | A | * | 7/1967 | Bettino | 404/131 |
| 4,175,885 | A | | 11/1979 | Jeppson | 404/77 |
| 4,252,487 | A | * | 2/1981 | Jeppson | 404/77 |
| 4,319,856 | A | * | 3/1982 | Jeppson | 219/699 |
| 4,590,348 | A | | 5/1986 | Lahti et al. | 219/10.55 M |
| 4,765,773 | A | * | 8/1988 | Hopkins | 404/94 |
| 5,101,087 | A | * | 3/1992 | Brotz | 100/334 |
| 5,141,059 | A | | 8/1992 | Marsh | 172/1 |
| 5,209,604 | A | | 5/1993 | Chou | 405/128 |
| 5,463,821 | A | * | 11/1995 | Gauer | 34/261 |
| 5,653,552 | A | | 8/1997 | Wiley et al. | 404/77 |
| 5,733,408 | A | * | 3/1998 | Zeidler | 156/379.9 |
| 5,797,194 | A | | 8/1998 | Zettergren | 34/259 |
| 5,895,171 | A | | 4/1999 | Wiley et al. | 404/77 |
| 6,185,836 | B1 | * | 2/2001 | Zaoralek | 34/119 |

* cited by examiner

*Primary Examiner*—Robert E. Pezzuto
*Assistant Examiner*—Raymond W. Addie
(74) *Attorney, Agent, or Firm*—Carothers & Carothers

(57) ABSTRACT

An apparatus for drying and compacting earthen materials such as soil which includes a motorized tractor vehicle with a microwave applicator attached to the vehicle. The microwave applicator includes a microwave permeable drum for rolling over the ground surface to be dried and a microwave heater element in the form of a magnetron tube coaxially disposed in the drum for emitting and directing microwaves downwardly through the drum into underlying soil to be dried. A microwave nonpermeable shield covers over side and upper surfaces of the drum and further includes a microwave reflective inner lining for reflecting microwaves downwardly into the underlying earth.

13 Claims, 3 Drawing Sheets

APPARATUS FOR DRYING AND COMPACTING EARTHEN MATERIALS

BACKGROUND OF THE INVENTION

The present invention relates to apparatus for effectively achieving optimum/preferred compaction and moisture content of earthen materials such as soil, as required prior to constructing, applying lifts of fill material or paving thereover.

Prior to erecting structures, lifting fill areas or paving parking lots for commercial use, the soil thereunder has to be analyzed by a geotechnical engineer using a troxler probe which analyzes the present condition of the soil which then must match laboratory information such as specific density and moisture content. If these conditions are not to the satisfaction of the geotechnical engineer, the material may have to be fluffed with machinery to dry in the sun and then recompacted after the proper moisture content is attained, or worse yet, the material may have to be removed and exported and suitable new material imported and substituted in its place. This of course causes an expensive loss of time and production, particularly during extensive rain periods, with the possible penalty inducing on tight deadlines. It can further cause the application of penalty fines and the shutting down of jobs because of silt and erosion problems.

SUMMARY OF THE INVENTION

The apparatus of the present invention for drying and compacting earthen materials such as soil, includes in combination a vehicle, such as a motorized tractor, and a microwave applicator attached to the vehicle. The microwave applicator includes a microwave permeable drum for rolling over the ground surface, and a microwave heater element including a magnetron fuse and wave guide assembly (magnetron fuse rod) is disposed in the drum for emitting and directing microwaves downwardly through the drum into underlying soil to be dried. The microwave applicator further includes an electrical generator, a high voltage transformer, and a control that are mounted on the vehicle for regulating the intensity of microwave energy emitted from the magnetron fuse in relation to the present condition of the material on hand to be treated.

The vehicle includes an operator's cab which has microwave nonpermeable shielding for protecting the operator in the cab from microwave contamination when operating the equipment. A microwave nonpermeable shield cover is also provided over the side and upper surfaces of the drum to prevent microwave radiation from escaping to unwanted areas. A microwave reflective inner lining is also provided in the cover for reflecting microwaves downwardly into the underlying soil. Furthermore, a triple layer ground hugging skirt is provided to seal the base of the shield to the ground. Internal steam and heat exhaust is forced by fans through a microwave baffle port making the entire microwave applicator assembly a microwave tight system.

A compactor is also preferably attached to the vehicle for compacting the underlying soil. Generally the compactor will be a vibratory roller compactor that is attached to the rear end of the motorized tractor vehicle, and the drum with the microwave heating element is attached to the front end of the vehicle.

Cooling is also provided for the drum and the microwave heater element contained therein and will generally be provided in the form of one or more motorized fans mounted inside the drum with ventilation apertures provided in the ends of the drum. Additional cooling may be provided by including one or more fans mounted on the shield cover which covers over the side and upper surfaces of the drum for thereby moving cooling air over the drum.

The microwave heater element will normally include a magnetron fuse rod coaxially mounted in the drum and an electric generator is mounted on the motorized tractor vehicle which transmits electricity to a high voltage transformer and then in turn to the magnetron fuse rod for energization thereof to provide microwave emission.

The motorized vehicle will normally be provided in the form of a motorized tractor with dual tracks that have elastomer tread guard inserts in order to protect surfaces over which it rides. A track vehicle is suggested as opposed to a articulating dual roller device to provide traction and less down pressure in even the worst of conditions.

BRIEF DESCRIPTION OF THE DRAWINGS

Other objects and advantages appear hereinafter in the following description and claims. The appended drawings show, for the purpose of exemplification, without limiting the invention or claims thereto, certain practical embodiments of the present invention wherein:

DETAILED DESCRIPTION OF THE PREFERRED EMBODIMENT

Figure 1:
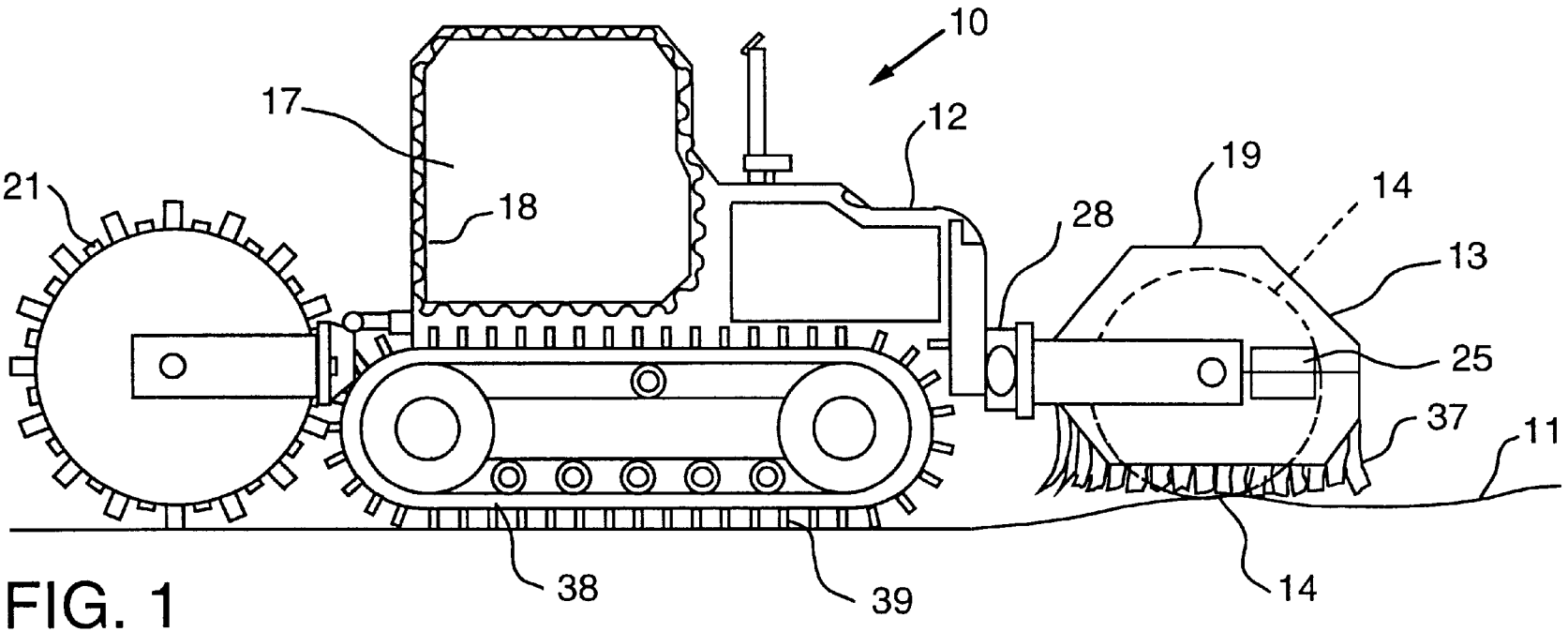
FIG. 1 is a schematic drawing illustrating in side elevation the apparatus of the present invention for drying and compacting earthen materials.
Figure 2:
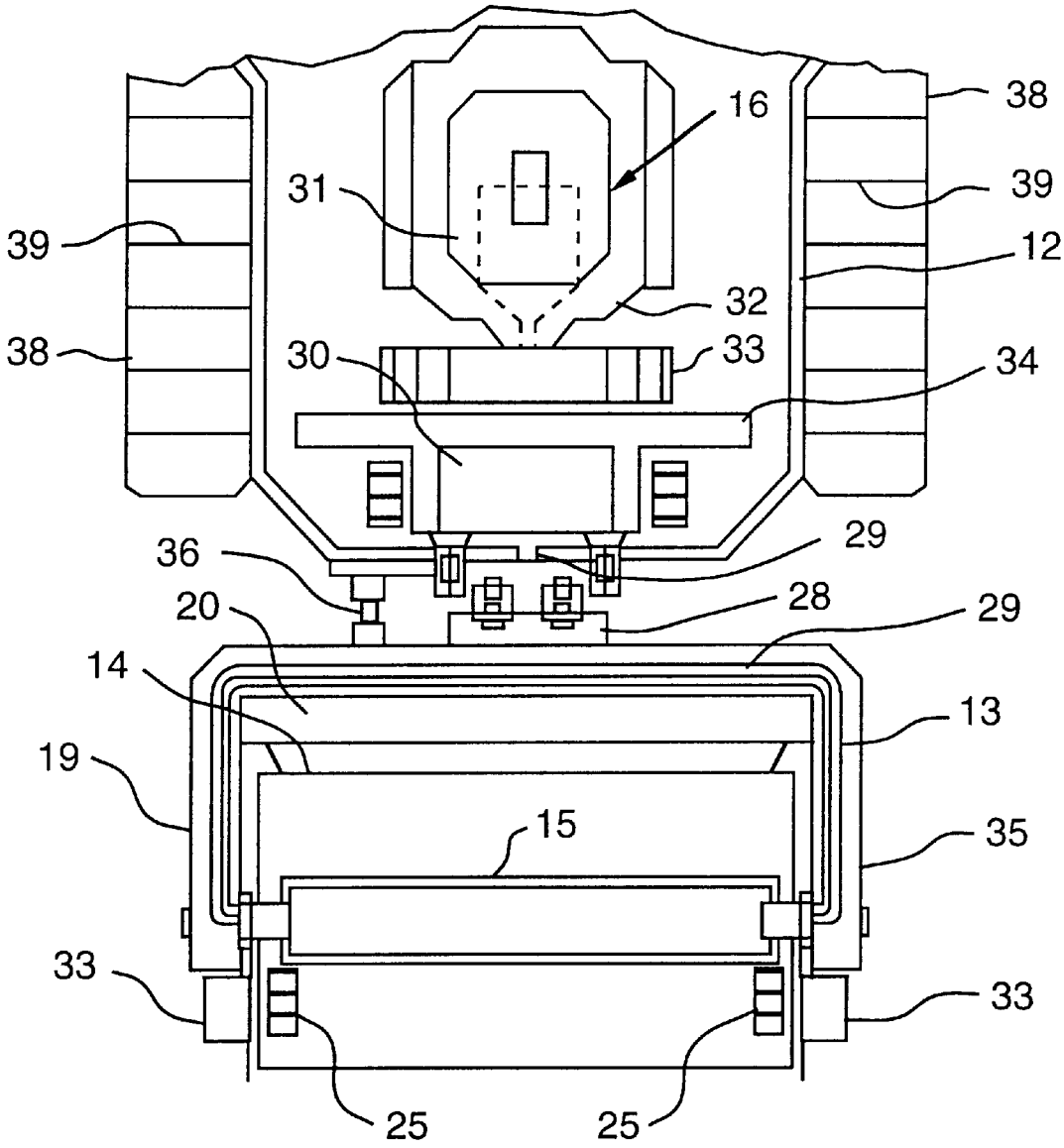
FIG. 2 is a top or plan schematic drawing of the front or right hand portion of the apparatus shown in FIG. 1 with portions removed to reveal interior structure.
Figure 3:
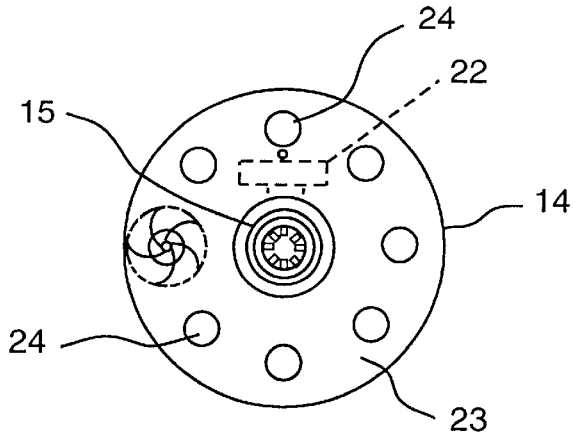
FIG. 3 is a schematic end view of the drum and microwave heater element as seen along section line III—III FIG. 4.
Figure 4:
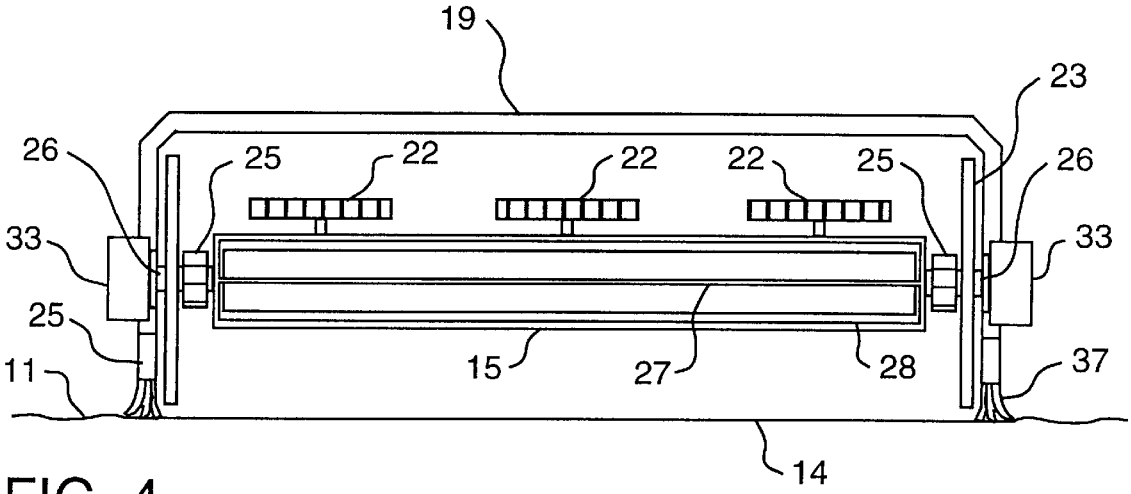
FIG. 4 is a schematic illustration in front elevation showing the front end of the apparatus of FIG. 1 with the drum and its cover in mid vertical cross section to illustrate the interior.

The apparatus 10 of the present invention for drying a compacting earthen material such as underlying soil 11 includes a motorized tractor vehicle 12 with a microwave applicator 13 attached to the front end of the vehicle 12. Microwave applicator 13 includes a microwave permeable drum 14 for rolling over ground surface 11 and a microwave heater element 15 disposed in drum 14 for emitting and directing microwaves downwardly therefrom through drum 14 into the underlying soil 11 to be dried.

The microwave applicator 13 further includes an electric generator 16 with controls mounted in the vehicle 12 for regulating the intensity of microwave energy emitted from heater element 15.

The motorized tractor vehicle 12 includes an operator's cab 17 with microwave nonpermeable shielding 18 shielding the cab for protecting an operator within the cab 17 from microwave contamination. A microwave nonpermeable shield 19 is also provided to cover over side and upper surfaces of drum 14 to prevent emission of microwaves to unwanted areas. This cover 19 also includes a microwave reflective inner lining 20 for reflecting all microwaves downwardly into the underlying earth 11 and a microwave impermeable and reflective ground hugging skirt 37.

A vibratory roller compactor 21 of conventional design is also secured to the rear end of vehicle 12 with microwave drum 14 being secured to the front end of tractor 12 so that as the soil is dried to the desired consistency it is immediately thereafter compacted by roller vibratory compactor 21 as vehicle 12 moves forward as seen in FIG. 1.

A cooling mechanism is provided to cool drum 14 and microwave heater element 15 in the form of three motorized fans 22 provided within the interior of drum 14 and mounted on the upper side of microwave heater element 15. The ends 23 of drum 14 are provided with ventilation apertures 24 to provide appropriate moving air ventilation.

Electric fans 25 are also provided in the sides of cover 19 to evacuate heat and steam from within cover 19. Microwave baffle external exhaust ports 33 are provided for fans 25 to prevent microwave leakage through the exhaust ports.

The microwave nonpermeable drum 14 rotates on stationary shaft ends 26, which shaft ends also coaxially support magnetron tube heater element 15 within drum 14 as illustrated. The magnetron tube has a cathode core 27 and a charged outer cylindrical shell 28.

Microwave heater element 15 is energized from electric lines that lead from opposite ends of the shafts 26 back through flexible coupling 28 to tractor 12. This flexible electrical cable is illustrated at 29 and leads to high voltage transformer 30 which in turn is connected to an electrical generator with controls as indicated at 31 for supplying 110V AC. Generator 31 runs off of the fly wheel of engine 32 of tractor 12. The engine 32 is typically cooled with the combination of a motor driven fan 33 and water cooled radiator system 34 which not only cools the engine but also cools the high voltage microwave transformer 30.

The microwave applicator 13 is capable of developing in excess of 1300 watts of power at 2,450 MHz.

While the magnetron tube of heater element 15 is illustrated as being cooled with fans 22, as an alternative one of ordinary skill in the art will appreciate that it may be liquid cooled.

Conventional hydraulics are utilized to manipulate roller 14 about the flexible forward coupling 28 in a horizontal plane by hydraulic cylinder 36. Similar hydraulic drives are provided for the rotary vibrating compactor 21 mounted at the rear of tractor 12 and both drives are hydrostatically synchronized with the dual tracks 38 for steering right and left.

The Y-frame 35 holding and mounting the microwave applicator 13, including magnetron tube heater element 15 and cover 19, is constructed of a heavy alloy to add down pressure on the drum 14 to provide some minimal compaction and leveling of the earth surface 11 and to minimize small eruptions of steam from the treated surface leaving as smooth a finished surface as possible.

The tractor treads or tracks 38 tractor vehicle 12 are provided with elastomer tread inserts 39 in order to protect underlying surfaces, such as driveways and other finished surface areas. The elastomer tread inserts also provide a electrical insulation for the vehicle 12 from ground.

If desired, it is also practical to provide a Proctor Analyzer (not shown), that is supplied by an onsite geotechnical engineer, aboard the motorized tractor vehicle 12 which can be fed necessary information regarding the condition of the underlying soil, such as specific density and moisture content. The Proctor Analyzer can thus be directly connected to the controls for the microwave applicator 13 to accordingly vary the intensity of microwave emission by the Proctor Analyzer analysis to permit optimum moisture and compaction to be achieved while efficiently avoiding over or under drying. The device as presently shown is set for manual operation allowing a trained operator to select his own settings for microwave application.

I claim:

1. Apparatus for drying earthen materials, comprising:

a vehicle;

a microwave applicator attached to said vehicle;

said microwave applicator including a microwave permeable drum for rolling over a ground surface and a microwave heater element disposed in said drum for emitting and directing microwaves downwardly through said drum into underlying soil to be dried.

2. The apparatus of claim 1, wherein said microwave applicator includes a microwave generator and control mounted on said vehicle for regulating the intensity of microwave energy emitted from said heater element.

3. The apparatus of claim 2, said vehicle including a motorized tractor having an operator's cab, said cab having microwave nonpermeable shielding for protecting an operator in said cab from microwave contamination.

4. The apparatus of claim 3 including a microwave nonpermeable shield cover over side and upper surfaces of said drum.

5. The apparatus of claim 4, said cover including a microwave reflective inner lining for reflecting microwaves downwardly.

6. The apparatus of claim 1, including a compactor attached to said vehicle for compacting underlying ground surface.

7. The apparatus of claim 6, wherein said compactor is a vibratory roller compactor.

8. The apparatus of claim 7, wherein said vehicle is a motorized tractor having a front end and a rear end and said drum is secured to the front end and said compactor is secured to the rear end.

9. The apparatus of claim 1, including cooling means for cooling said drum.

10. The apparatus of claim 9, wherein said cooling means includes at least one motorized fan mounted inside said drum and ventilation apertures in side ends of said drum.

11. The apparatus of claim 9, wherein said cooling means includes a cover over side and upper surfaces of said drum and a ventilation fan mounted on said cover for moving cooling air over said drum.

12. The apparatus of claim 1, said microwave heater element including a magnetron fuse rod coaxially mounted in said drum and said microwave applicator including a microwave generator mounted on said vehicle and electrically connected to said rod through a high voltage transformer for energization thereof to provide microwave emission.

13. The apparatus of claim 1, wherein said vehicle is a motorized tractor with dual tracks having elastomer tread guards.

* * * * *